US011657942B2

(12) United States Patent
Zhu et al.

(10) Patent No.: US 11,657,942 B2
(45) Date of Patent: May 23, 2023

(54) SUPPORT APPARATUS AND FLEXIBLE DEVICE

(71) Applicant: Wuhan Tianma Micro-Electronics Co., Ltd., Wuhan (CN)

(72) Inventors: Qifeng Zhu, Wuhan (CN); Qian Xu, Wuhan (CN)

(73) Assignee: Wuhan Tianma Micro-Electronics Co., Ltd., Wuhan (CN)

( * ) Notice: Subject to any disclaimer, the term of this patent is extended or adjusted under 35 U.S.C. 154(b) by 294 days.

(21) Appl. No.: 17/186,887

(22) Filed: Feb. 26, 2021

(65) Prior Publication Data

US 2022/0172870 A1 Jun. 2, 2022

(30) Foreign Application Priority Data

Nov. 30, 2020 (CN) ..... 202011380884.X

(51) Int. Cl.
*H01F 7/08* (2006.01)
*H01F 7/06* (2006.01)
*H01F 7/126* (2006.01)

(52) U.S. Cl.
CPC ..... *H01F 7/081* (2013.01); *H01F 7/064* (2013.01); *H01F 7/126* (2013.01); *H01F 2007/086* (2013.01)

(58) Field of Classification Search
CPC ..... H01F 7/064; H01F 7/081; H01F 7/126; H01F 7/20; H01F 2007/086
USPC ..... 361/143
See application file for complete search history.

(56) References Cited

U.S. PATENT DOCUMENTS

2020/0192482 A1* 6/2020 Watanabe ..... G06F 3/044

FOREIGN PATENT DOCUMENTS

| | | | | |
|---|---|---|---|---|
| CN | 1799784 A | * | 7/2006 | |
| CN | 1799784 A | | 7/2006 | |
| CN | 109521577 A | * | 3/2019 | ..... G02B 27/2271 |
| CN | 109521577 A | | 3/2019 | |

OTHER PUBLICATIONS

Machine translation of Gong et al. Chinese Patent Document CN 1799784 A Dec. 31, 2004 (Year: 2004).*
Machine translation of Hu Chinese Patent Document CN 109521577 A Dec. 29, 2018 (Year: 2018).*
Chinese Office Action related to Application No. 202011380884.X; dated Apr. 19, 2022.

* cited by examiner

*Primary Examiner* — Kevin J Comber
(74) *Attorney, Agent, or Firm* — von Briesen & Roper, s.c.

(57) ABSTRACT

Provided are a support apparatus and a flexible device. The support apparatus comprises a support substrate, an electromagnetic support cavity array which is located on the support substrate and includes a plurality of electromagnetic support cavities, a plurality of magnetic field generation circuits, and a control module, where the magnetic field generation circuits are electrically connected to the control module, and the control module is configured to control the plurality of magnetic field generation circuits to generate magnetic fields to make the electromagnetic support cavities deform along a direction perpendicular to a plane in which the support substrate is located. Through the scheme, the electromagnetic support cavity array is provided on the support substrate, and the magnetic field generation circuits are controlled by the control module to generate magnetic fields.

18 Claims, 11 Drawing Sheets

SUPPORT APPARATUS AND FLEXIBLE DEVICE

CROSS-REFERENCE TO RELATED APPLICATIONS

This application claims priority to Chinese patent application No. 202011380884.X filed with CNIPA on Nov. 30, 2020, the disclosure of which is incorporated herein by reference in its entirety.

TECHNICAL FIELD

The present disclosure relates to the field of flexible displays and, in particular, to a support apparatus and a flexible device.

BACKGROUND

With the development of flexible display technology, flexible display screens are increasingly applied to mobile terminals, and flexible display screens are formed into different forms of flexible curved surfaces by using a flexible screen support structure.

The method for forming flexible display screens into different forms of flexible curved surfaces includes: placing a mechanical telescopic support frame with a drive motor or an airbag with a sensor on the back surface of the flexible display screen, and through a relative movement of the telescopic support frame or a shape change of the airbag making the flexible display screen be formed into different forms of flexible curved surfaces, such as a concave curved surface, a convex curved surface, or a wave-shaped curved surface. Since the existing flexible screen support structure adopts the mechanical transmission device and needs to be driven by the motor, such a structure is complicated in structure, occupies large internal space and has a relatively large weight, which makes it difficult to satisfy the requirement of being portable.

SUMMARY

The present disclosure provides a support apparatus and a flexible device to form flexible display screens into different forms of flexible curved surfaces by using the support apparatus.

In an embodiment, the present disclosure provides a support apparatus. The support apparatus includes:

a support substrate, an electromagnetic support cavity array which is located on the support substrate and includes multiple electromagnetic support cavities; and multiple magnetic field generation circuits and a control module, where the multiple magnetic field generation circuits are electrically connected to the control module, and the control module is configured to control the multiple magnetic field generation circuits to generate magnetic fields to make the multiple electromagnetic support cavities deform along a direction perpendicular to a plane in which the support substrate is located.

In an embodiment, based on the same concept, the present disclosure further provides a flexible device including a flexible object and a support apparatus. The support apparatus includes: a support substrate, an electromagnetic support cavity array which is located on the support substrate and includes multiple electromagnetic support cavities; and multiple magnetic field generation circuits and a control module, where the multiple magnetic field generation circuits are electrically connected to the control module, and the control module is configured to control the multiple magnetic field generation circuits to generate magnetic fields to make the multiple electromagnetic support cavities deform along a direction perpendicular to a plane in which the support substrate is located.

The flexible object is located on a side of the electromagnetic support cavity array facing away from the support substrate.

The present disclosure provides the support apparatus and the flexible device, the support apparatus includes the support substrate, the electromagnetic support cavity array, the multiple magnetic field generation circuits, and the control module. When the flexible object is provided on a side of the electromagnetic support cavity array facing away from the support substrate, the control module in the support apparatus may control the strength of magnetic field signals output by the magnetic field generation circuits, and each electromagnetic support cavity in the electromagnetic support cavity array deforms to a bent curved surface in the direction perpendicular to the plane in which the support substrate is located according to the strength of magnetic field signals generated by the magnetic field generation circuits, so that the flexible object located on the electromagnetic support cavity array is formed into a target curved shape.

DETAILED DESCRIPTION

Figure 1:
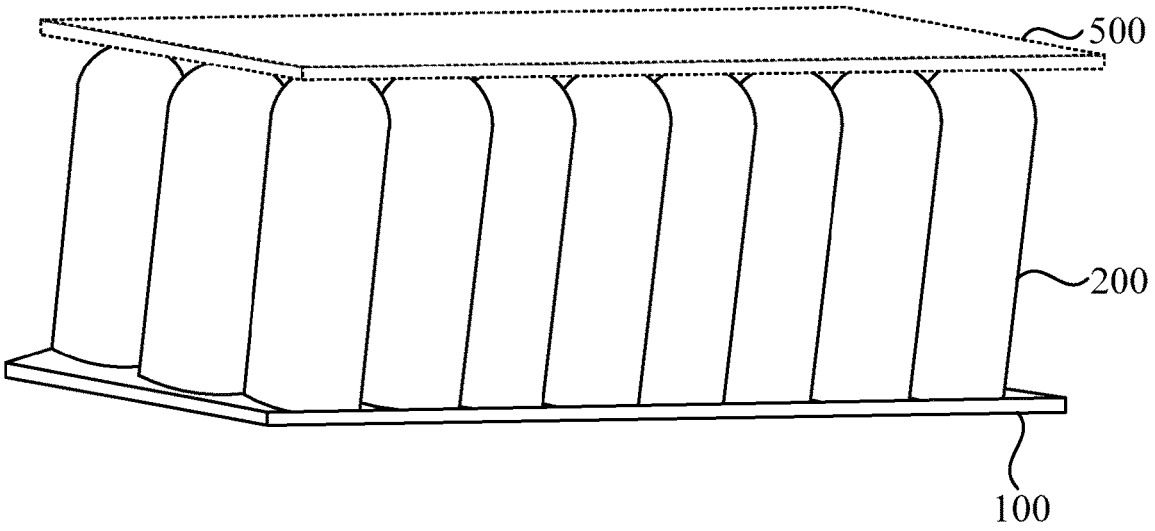
FIG. 1 is a structural diagram of a support apparatus according to an embodiment of the present disclosure.

Hereinafter the present disclosure will be further described in detail in conjunction with drawings and embodiments. It is to be understood that the embodiments set forth herein are intended to explain the present disclosure and not to limit the present disclosure. Additionally, it is to be noted that for ease of description, merely part, not all, of the structures related to the present disclosure are illustrated in the drawings.

FIG. 1 is a structural diagram of a support apparatus according to an embodiment of the present disclosure. As shown in FIG. 1, the support apparatus includes a support substrate 100 and an electromagnetic support cavity array 200. The electromagnetic support cavity array 200 is located on the support substrate 100 and includes multiple electromagnetic support cavities 10. The support apparatus further includes multiple magnetic field generation circuits and a control module (not shown in FIG. 1). The multiple magnetic field generation circuits are electrically connected to the control module, and the control module is configured to control the multiple magnetic field generation circuits to generate magnetic fields, so that the multiple electromagnetic support cavities 10 deform along a direction perpendicular to a plane in which the support substrate 100 is located.

Exemplarily, when a flexible object 500 (which is exemplarily represented by using the dashed lines in FIG. 1) located on the electromagnetic support cavity array 200 has a concave bend, the control module, at this point, acquires a pressure value at each position of the flexible object 500 located on the electromagnetic support cavity array 200 and controls the multiple magnetic field generation circuits to generate magnetic fields. That is, corresponding to pressure values at different positions of the flexible object 500, the control module controls the magnetic fields generated by the multiple magnetic field generation circuits to be different in magnitude to make electromagnetic forces received by the electromagnetic support cavities 10 at different pressure positions to be different, so that the electromagnetic support cavities 10 stretch or contract according to the strength of the magnetic field signals generated by the magnetic field generation circuits. When the bending shape of the flexible object 500 located on the electromagnetic cavity support array 200 needs to be adaptively changed, the control module at this point may control the magnetic field generation circuits to generate magnetic fields, so that the electromagnetic forces received by the electromagnetic support cavities 10 at different positions are different, so to automatically adjust the stretch or contraction range of each electromagnetic support cavity 10, thereby forming the flexible object 500 into a target bending shape.

Figure 2:
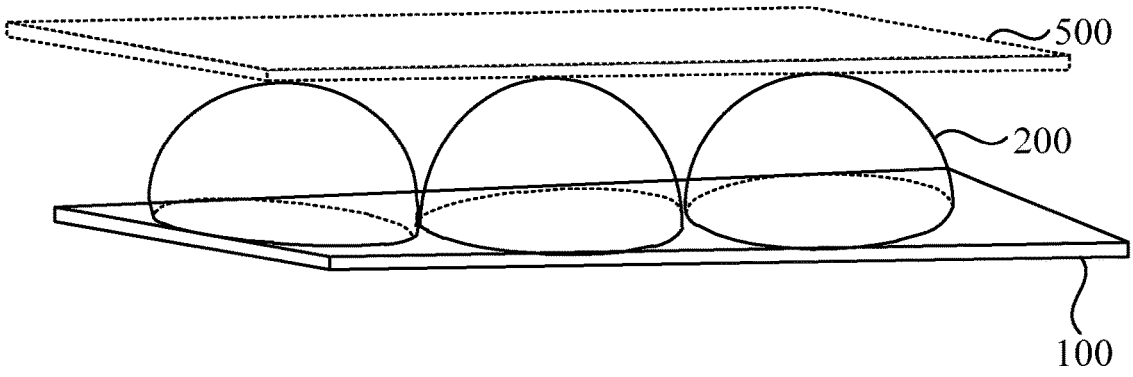
FIG. 2 is another structural diagram of a support apparatus according to an embodiment of the present disclosure.

It is to be noted that FIG. 1 illustrates that each electromagnetic support cavity 10 is in a cylindrical shape, while the electromagnetic support cavities 10 may also be in a hemispherical shape as shown in FIG. 2, and the embodiments of the present disclosure do not limit the structure of the electromagnetic support cavities 10.

The support apparatus provide by the embodiments of the present disclosure includes a support substrate, an electromagnetic support cavity array, multiple magnetic field generation circuits, and a control module. When a flexible object is provided on a side of the electromagnetic support cavity array facing away from the support substrate, the control module in the support apparatus may control the strength of magnetic field signals output by the magnetic field generation circuits, and each electromagnetic support cavity in the electromagnetic support cavity array deforms in the direction perpendicular to the plane in which the support substrate is located according to the strength of magnetic field signals generated by magnetic field generation circuits to form a bent curved surface, so that the flexible object located on the electromagnetic support cavity array is formed into a target curved shape.

Figure 3:
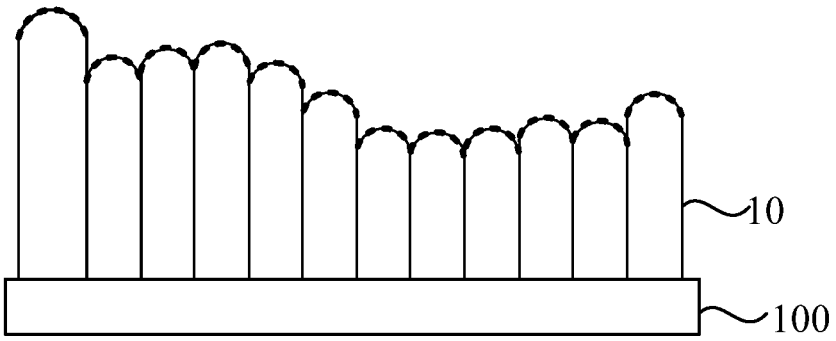
FIG. 3 is a sectional view of a support apparatus according to an embodiment of the present disclosure.

On the basis of the above embodiments, FIG. 3 is a sectional view of a support apparatus according to an embodiment of the present disclosure. As shown in FIG. 3, the side of the electromagnetic support cavity array 200 facing away from the support substrate 100 is an arc surface (which is exemplarily represented by using the dashed line in FIG. 3).

The side of the electromagnetic support cavity array 200 facing away from the support substrate 100 is set to be an arc surface, and the magnetic fields generated by the magnetic field generation circuits 300 make the electromagnetic support cavities 10 deform in the direction perpendicular to the plane in which the support substrate 100 is located, so the electromagnetic support cavities 10 in the arc shape can implement a smooth transition of the flexible object located on the electromagnetic support cavities 10, thereby avoiding the phenomenon that the flexible object located on the electromagnetic support cavities 10 has a right-angle bend or a dart when the electromagnetic support cavities 10 deform.

The side of the electromagnetic support cavity array 200 facing away from the support substrate 100 may be configured to carry the flexible object 500.

Figure 4:
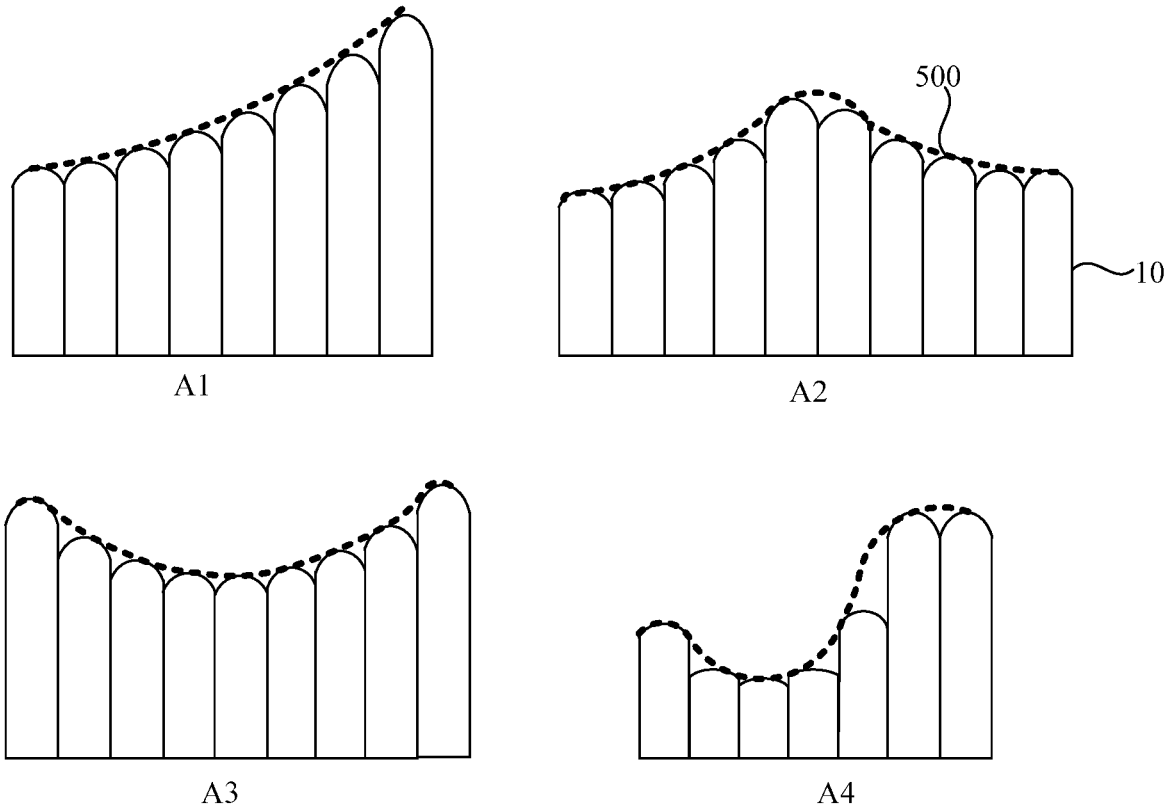
FIG. 4 is a schematic diagram of a deformation of an electromagnetic support cavity array according to an embodiment of the present disclosure.

Exemplarily, in conjunction with FIGS. 1 and 4, the flexible object 500 is carried on the side of the electromagnetic support cavity array 200 facing away from the support substrate 100. When the control module controls the magnetic fields generated by the magnetic field generation circuits to make the electromagnetic support cavities 10 deform in the direction perpendicular to the plane in which the support substrate 100 is located, the flexible object 500 located on the electromagnetic support cavities 10 may be formed into a flexible curved surface having different forms according to the deformation manner of the electromagnetic support cavities 10. FIG. 4 illustrates four types of deformation manner of the flexible object while the flexible object may also be in other types of deformation manner, and the embodiments of the present disclosure do not limit the deformation manner of the flexible object.

Figure 5:
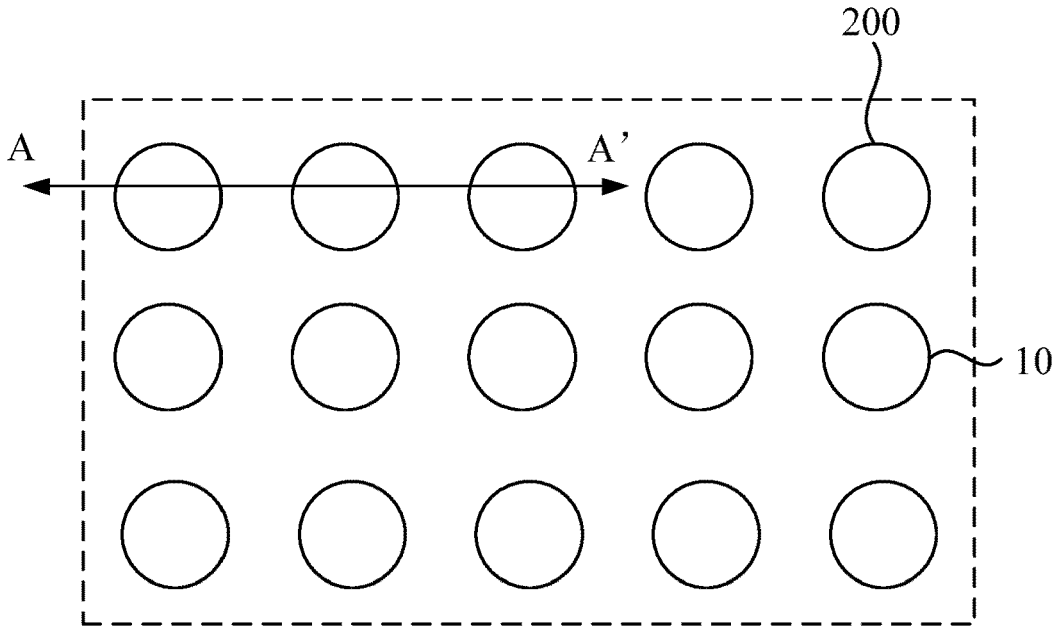
FIG. 5 is a top view of electromagnetic support cavities according to an embodiment of the present disclosure.
Figure 6:
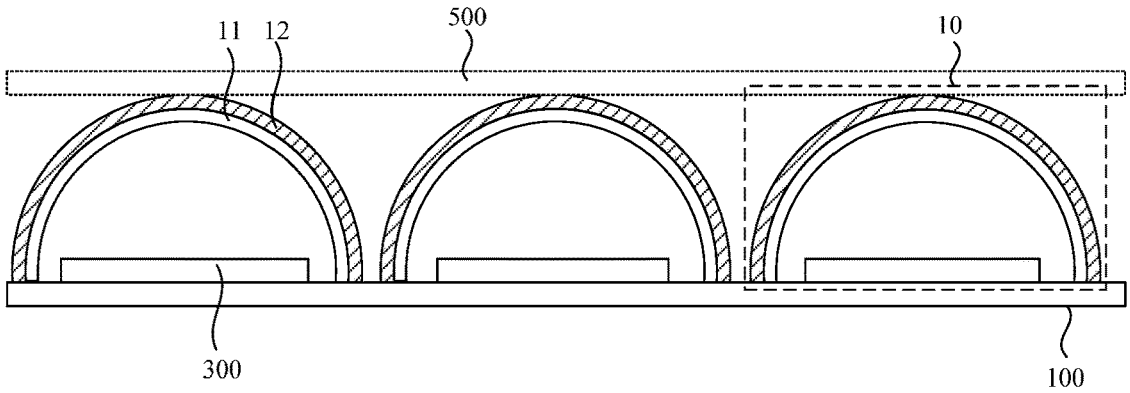
FIG. 6 is a sectional view taken along line AA' of the electromagnetic support cavities illustrated in FIG. 5.

On the basis of the above embodiments, FIG. 5 is a top view of electromagnetic support cavities according to an embodiment of the present disclosure, and FIG. 6 is a sectional view taken along line AA' of the electromagnetic support cavities illustrated in FIG. 5. As shown in FIG. 5 and FIG. 6, each electromagnetic support cavity 10 includes an electromagnetic material layer 11 and a protection layer 12, and the protection layer 12 is located on an outer side wall of the electromagnetic material layer 11.

Exemplarily, as shown in FIG. 6, each electromagnetic support cavity 10 is provided with the electromagnetic material layer 11, and the electromagnetic material layer 11 deforms under the action of the magnetic field signals generated by the magnetic field generation circuits 300 to make the electromagnetic support cavities deform in the direction perpendicular to the plane in which the support substrate 100 is located, so that the flexible object 500 located on the electromagnetic support cavities 10 is formed into a target curved shape. The protection layer 12 is provided on the outer side wall of the electromagnetic material layer 11 and used to protect the electromagnetic material layer 11.

As shown in FIG. 5, there is a gap located between adjacent electromagnetic support cavities. When the support apparatus is applied to carry flexible objects of different sizes, the support apparatus is adapted to the flexible objects of different sizes by changing gaps located between adjacent electromagnetic support cavities, which has wide applicability.

Exemplarily, the material of the protection layer 12 is set to include high-molecular polymeric materials such as polytetrafluoroethylene. The protection layer may have a thickness within a range of 80 um to 120 um.

When the thickness of the protection layer 12 is set to be relatively thin, the relatively thin protection layer 12 cannot provide good protection for the electromagnetic material layer 11. When the thickness of the protection layer 12 is set to be relatively thick, the relatively thick protection layer 12 affects the amount of deformation of the electromagnetic material layer 11. Therefore, when the thickness of the protection layer 12 is set to be in the range of 80 um to 120 um, the protection layer does not affect the amount of deformation of the electromagnetic material layer 11 under the magnetic field signals generated by the magnetic field generation circuits while protecting the electromagnetic material layer 11.

Exemplarily, the electromagnetic material layer 11 may be set to include alloy materials, for example, the steel-aluminum alloy doped with non-metallic materials such as carbon or silicon. The embodiments of the present disclosure do not limit the electromagnetic material layer 11 so long as it is ensured that the electromagnetic material layer can interact with the magnetic field signals under the action of the magnetic fields generated by the magnetic field generation circuits. The thickness of the coating of the protection layer may have a range of 10 um to 30 um.

The thickness of the coating of the electromagnetic material layer 11 is set to range from 10 um to 30 um. When the thickness of the coating of the electromagnetic material layer 11 is relatively thin, the relatively thin electromagnetic material layer 11 under the action of the magnetic fields generated by the magnetic field generation circuits has a relatively small amount of deformation, so that the amount of deformation of the electromagnetic support cavities 10 in the direction perpendicular to the plane in which the support substrate 100 is located is affected. When the thickness of the electromagnetic material layer 11 satisfies the amount of deformation of the electromagnetic material layer 11, a relatively thick electromagnetic material layer 11 may cause a waste of electromagnetic materials.

Figure 7:
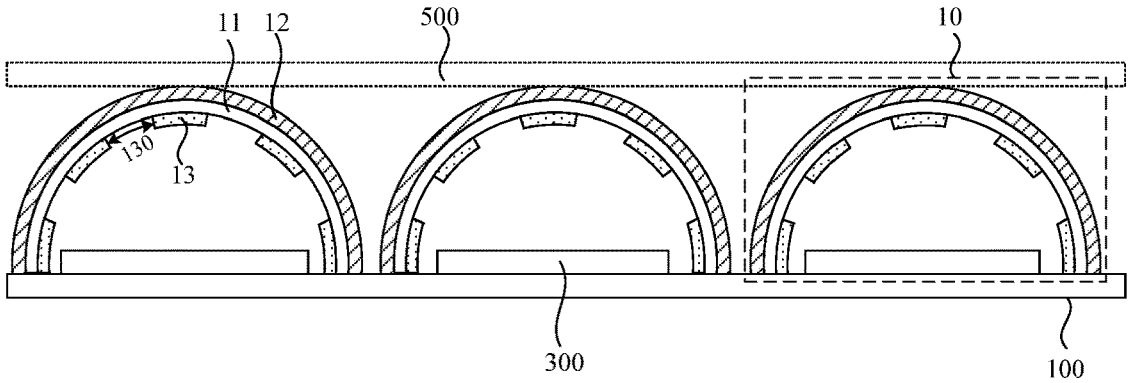
FIG. 7 is a sectional view of electromagnetic support cavities according to an embodiment of the present disclosure.

On the basis of the above embodiments, FIG. 7 is a sectional view of electromagnetic support cavities according to an embodiment of the present disclosure. As shown in FIG. 7, each electromagnetic support cavity may further include a magnetic field absorption layer 13. The magnetic field absorption layer 13 has a hollow pattern 130 and is located on an inner side wall of the electromagnetic material layer 11.

As shown in FIG. 7, the inner side wall of the electromagnetic material layer is provided with the magnetic field absorption layer 13, and the magnetic field absorption layer 13 includes the hollow pattern 130. When the electromagnetic support cavities 10 deform in the direction perpendicular to the plane in which the support substrate 100 is located according to the magnetic field signals generated by the magnetic field generation circuits 300, a position provided with the magnetic field absorption layer 13 on the electromagnetic material layer 11 does not deform since the magnetic field absorption layer 13 absorbs the magnetic field signals generated by the magnetic field generation circuits 300, while a position provided with no magnetic field absorption layer 13 on the electromagnetic material layer 11 deforms under the action of the magnetic fields generated by the magnetic field generation circuits. The electromagnetic material layer 11 enables the electromagnetic support cavities 10 to deform in the direction perpendicular to the plane in which the support substrate 100 is located according to the strength of electromagnetic signals at different positions.

Figure 8:
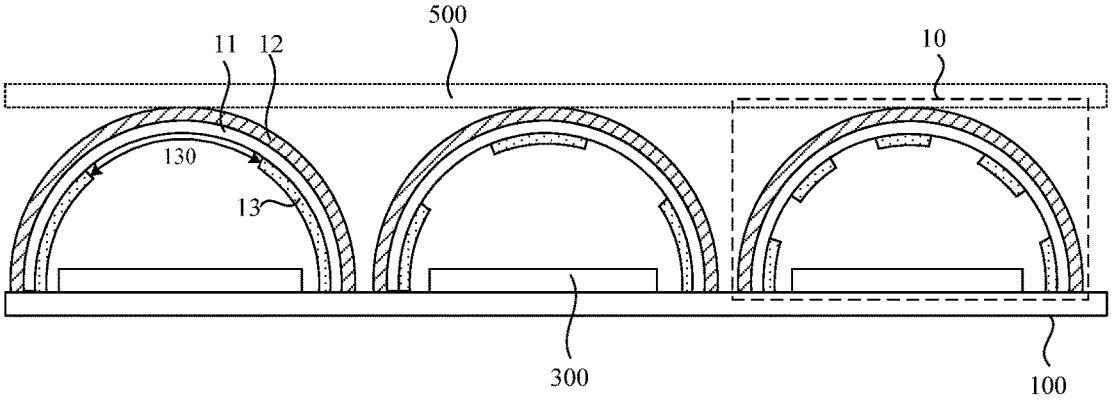
FIG. 8 is another sectional view of electromagnetic support cavities according to an embodiment of the present disclosure.

On the basis of the above embodiments, FIG. 8 is another sectional view of electromagnetic support cavities according to an embodiment of the present disclosure. As shown in FIG. 8, magnetic field absorption layers 13 of at least a partial number of the multiple electromagnetic support cavities 10 may have different areas. Exemplarily, as shown in FIG. 8, the magnetic field absorption layers 13 in different electromagnetic support cavities have different attachment areas on inner side walls of the electromagnetic material layers 11. At least a partial number of the multiple electromagnetic support cavities are set to have different areas of the magnetic field absorption layers 13. When the magnetic field signals output by the multiple magnetic field generation circuits 300 have the same strength/different strengths, the interaction between the magnetic field generated by the magnetic field generation circuit 300 and the electromagnetic material layer may be changed according to the area of the magnetic field absorption layer 13 in the corresponding electromagnetic support cavity to make the amount of deformation of the electromagnetic material layer different, so that the electromagnetic support cavities 10 deform in the direction perpendicular to the plane in which the support substrate 100 is located according to the amount of deformation generated on the electromagnetic material layer 11.

It is to be noted that FIG. 8 illustrates a manner of implementing different areas of the magnetic field absorption layers 13 of the electromagnetic support cavities 10 while such different areas may also be implemented in other manners, and the embodiments of the present disclosure do not limit the arrangement of the magnetic field absorption layer 13.

The multiple magnetic field generation circuits may be connected in series.

When the support apparatus is applied to carry a relatively large flexible object, the number of electromagnetic support cavities in the electromagnetic cavity support array of the support apparatus is large. When each electromagnetic support cavity in the electromagnetic cavity support array needs to deform in the direction perpendicular to the plane in which the support substrate is located, multiple magnetic field generation circuits are needed to generate magnetic field signals, respectively, and thus the circuit structure of the support apparatus is complex and a lot of output ports of the control module are occupied. Through a serial connection of the multiple magnetic field generation circuits, the phenomenon that a lot of output ports of the control module are occupied due to the large number of magnetic field generation circuits is avoided. When the multiple magnetic field generation circuits are connected in series, the magnetic field absorption layers in the magnetic field support cavities may be set to be different, so that the deformations generated by the electromagnetic material may be different and thus each electromagnetic support cavity has a different deformation.

With continued reference to FIG. 7, each electromagnetic support cavity 10 may have the same area of the magnetic field absorption layer 13, and the control module is configured to adjust magnetic fields generated by at least a partial number of the magnetic field generation circuits 300 to be different, so that the at least a partial number of the electromagnetic support cavities 10 deform differently along the direction perpendicular to the plane in which the support substrate 100 is located.

When each electromagnetic support cavity 10 has the same area of the magnetic field absorption layer 13, the control module adjusts the magnetic fields generated by at least a partial number of the magnetic field generation circuits 300, and in this manner, the deformation generated by the interaction in each electromagnetic support cavity 10 between the electromagnetic material layer 11 and the magnetic field generated by the magnetic field generation circuit 300 is related to the strength of the magnetic field signals generated by the corresponding magnetic field generation circuit 300, so that at least a partial number of the electromagnetic support cavities 10 deform differently in the direction perpendicular to the plane in which the support substrate 100 is located by changing the strengths of the magnetic field signals generated by the magnetic field generation circuits 300.

The magnetic field absorption layer 13 may include a carbon-based conductive polymer.

The magnetic field absorption layer is set to include a carbon-based conductive polymer, and the magnetic field signals generated by the magnetic field generation circuits are absorbed by the magnetic field absorption layer, so that the position provided with the magnetic field absorption layer on the electromagnetic material layer does not deform while the position provided without the magnetic field absorption layer on the electromagnetic material layer deforms, so that the electromagnetic support cavities deform differently in the direction perpendicular to the plane in which the support substrate is located according to the magnitude of the deformation force between the magnetic field absorption layer and the electromagnetic material layer.

It is to be noted that the embodiments of the present disclosure do not limit the material of the magnetic field absorption layer 13 so long as it is ensured that the provided material of the magnetic field absorption layer can absorb the magnetic field signals generated by the magnetic field generation circuit 300, so that the position provided with the magnetic field absorption layer on the electromagnetic material layer does not deform.

The thickness of the coating of the magnetic field absorption layer 13 may range from 10 um to 30 um.

Exemplarily, the thickness of the coating of the magnetic field absorption layer 13 ranges from 10 um to 30 um. When the thickness of the coating of the magnetic field absorption layer 13 is relatively thin, the relatively thin magnetic field absorption layer 13 cannot absorb the magnetic field signals generated by the magnetic field generation circuit 300 well, so that the position provided with the magnetic field absorption layer 13 on the electromagnetic material layer deforms; when the thickness of the coating of the magnetic field absorption layer 13 is relatively thick, the relatively thick magnetic field absorption layer 13 affects the amount of deformation of the electromagnetic material layer.

Figure 9:
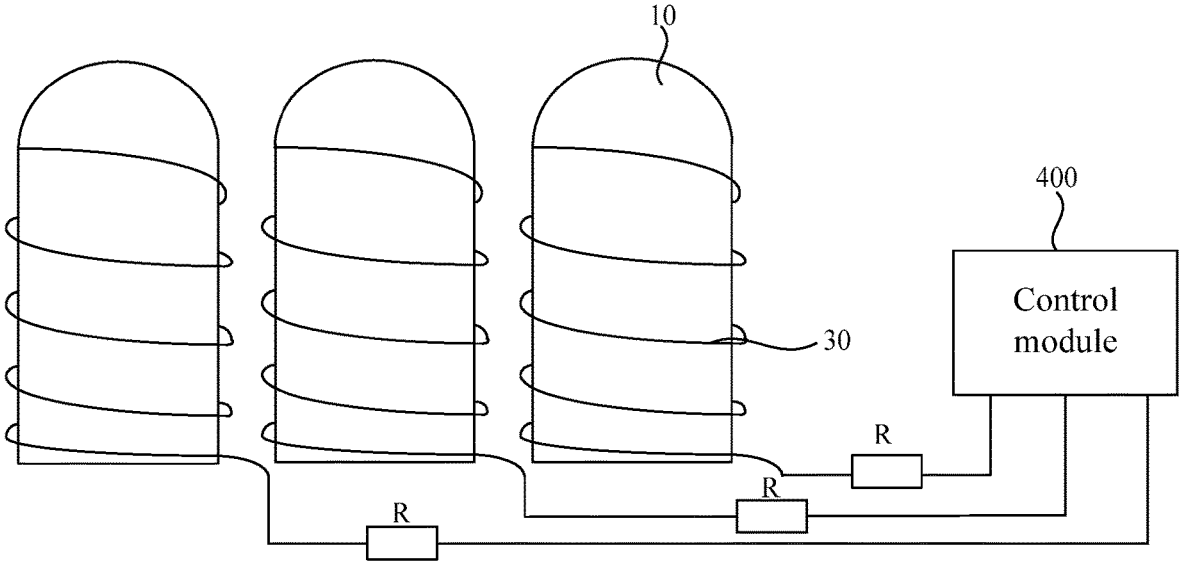
FIG. 9 is a structural diagram of a magnetic field generation circuit according to an embodiment of the present disclosure.

On the basis of the above embodiments, FIG. 9 is a structural diagram of a magnetic field generation circuit according to an embodiment of the present disclosure. As shown in FIG. 9, the magnetic field generation circuit 300 includes a spiral coil 30 located on an outer side wall of the respective electromagnetic support cavity 10.

Exemplarily, as shown in FIG. 9, the spiral coil 30 of the magnetic field generation circuit is located on the outer side wall of the respective electromagnetic support cavity 10, and the spiral coil 30 is electrically connected to the control module 400. When the flexible object located on the electromagnetic support cavity array bends, the control module 400 at this point controls spiral coils 30 located on outer side walls of different electromagnetic support cavities 10 to generate different electromagnetic forces, so that the electromagnetic support cavities 10 deform in the direction perpendicular to the plane in which the support substrate 100 is located according to the electromagnetic forces generated by the spiral coils 30 on the side walls of these electromagnetic support cavities 10.

Figure 10:
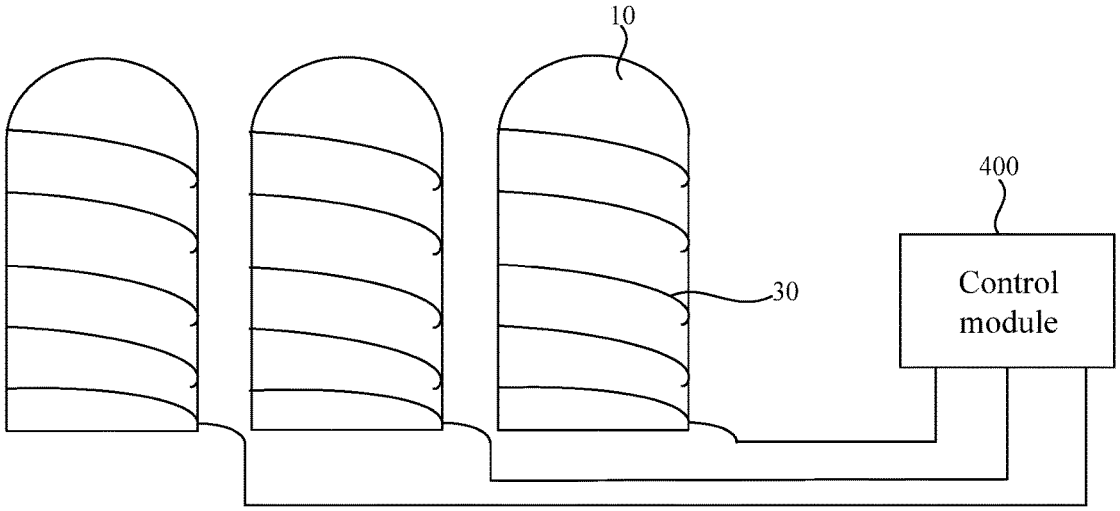
FIG. 10 is another structural diagram of a magnetic field generation circuit according to an embodiment of the present disclosure.

It is to be noted that FIG. 9 illustrates that the spiral coil 30 is provided on the outer side wall of the respective magnetic field support cavity 10 while the spiral coil 30 may also be provided on an inner side wall of the respective magnetic field support cavity 10. When the spiral coil 30 is provided on the inner side wall of the magnetic field support cavity 10, as shown in FIG. 10, the spiral coil 30 may be protected by the protection layer 12 in the magnetic field support cavity 10.

In other implementations, a current limiting resistor R may be provided on each magnetic field generation circuit 300. As shown in FIG. 9, a current limiting resistor R is provided on each magnetic field generation circuit 300. When the control module 400 controls the magnetic field generation circuits 300 to generate magnetic field signals, the current limiting resistors R located on the magnetic field generation circuits 300 may change the value of the current input into the magnetic field generation circuits 300, so as to change the strengths of the magnetic field signals generated by the magnetic field generation circuits 300.

In the embodiments of the present disclosure, the strength of the magnetic field signal can be adjusted by providing the spiral coil 30 in the corresponding magnetic field generation circuit. For example, the control module 400 may adjust the value of the current input into each spiral coil 30, and the larger the current is, the stronger the magnetic field generated by the magnetic field generation circuit is, and the larger the deformation of the electromagnetic support cavity 10 in the direction perpendicular to the plane in which the support substrate 100 is located under this magnetic field is.

Figure 11:
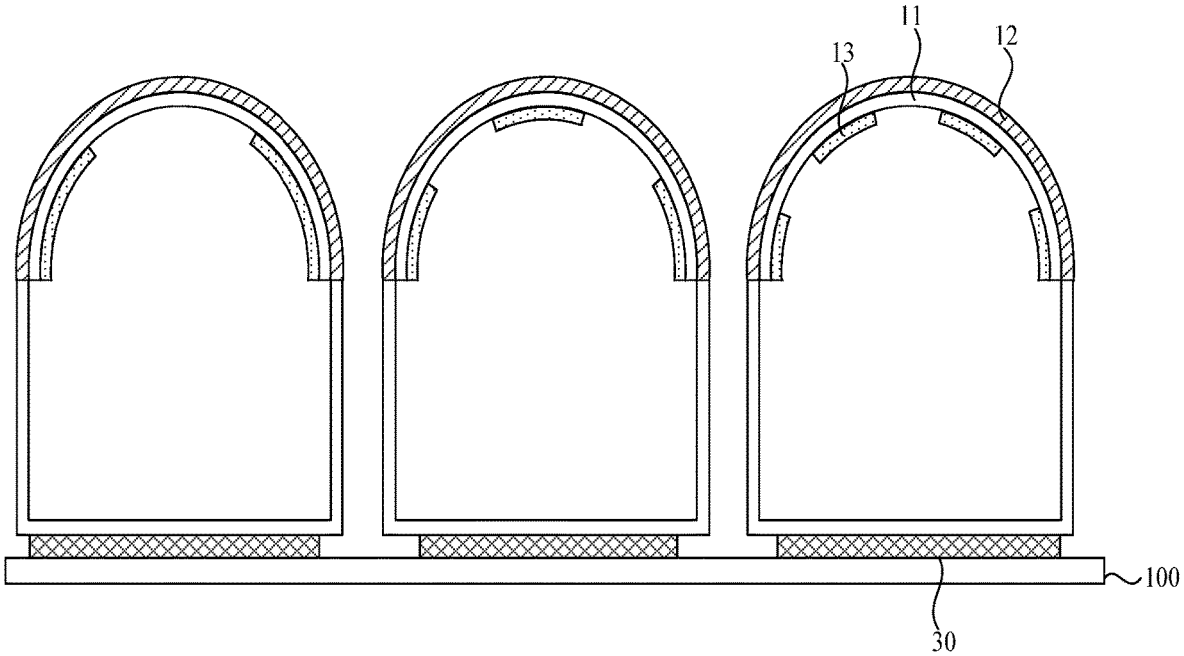
FIG. 11 is another sectional view of electromagnetic support cavities according to an embodiment of the present disclosure.

On the basis of the above embodiments, FIG. 11 is another sectional view of electromagnetic support cavities according to an embodiment of the present disclosure. As shown in FIG. 11, the magnetic field generation circuit includes a spiral coil 30 located on the support substrate 100.

Exemplarily, with reference to FIG. 11, the spiral coil 30 of the respective magnetic field generation circuit may be provided on the support substrate 10. When the flexible object located on the electromagnetic support cavity array bends, the control module at this point controls the spiral coils 30 located on different electromagnetic support cavities 10 to generate magnetic fields, so that the electromagnetic support cavities 10 deform in the direction perpendicular to the plane in which the support substrate 100 is located according to the magnetic fields generated by the spiral coils 30.

Figure 12:
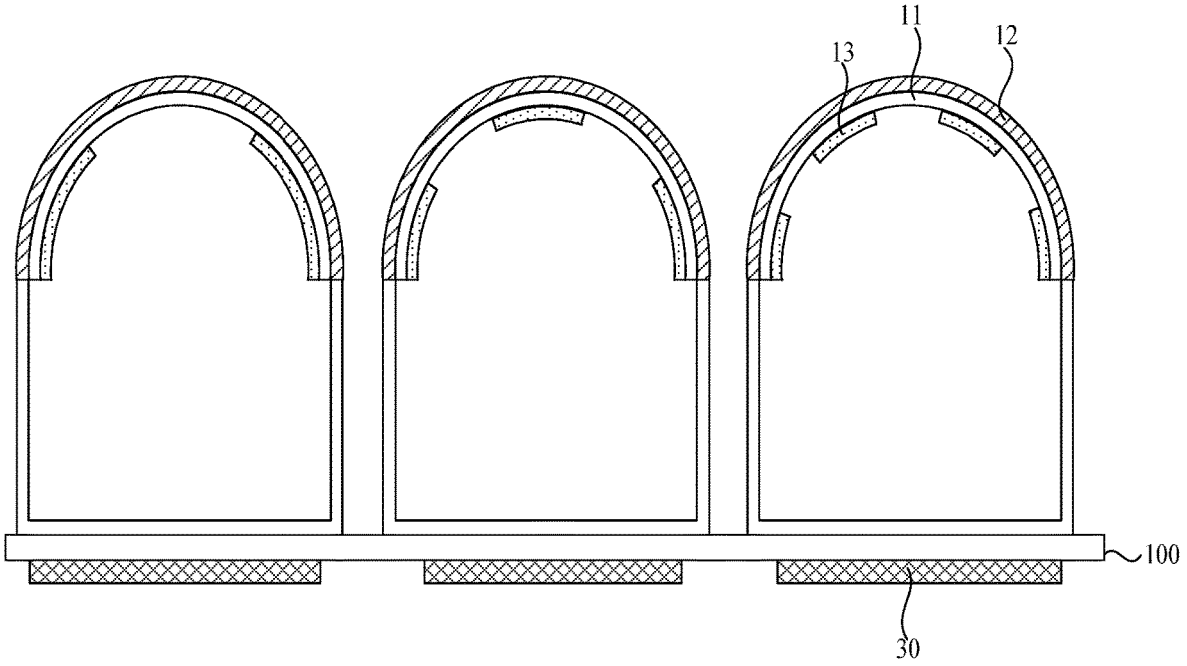
FIG. 12 is another sectional view of electromagnetic support cavities according to an embodiment of the present disclosure.

It is to be noted that FIG. 11 illustrates that the spiral coil is located on the side of the support substrate facing towards the electromagnetic support cavity array, and the spiral coil may also be located on the side of the support substrate facing away from the electromagnetic support cavity array. As shown in FIG. 12, the spiral coil 30 is located on the side of the support substrate 100 facing away from the electromagnetic support cavity array 200, and the electromagnetic support cavity 10 deforms in the direction perpendicular to the plane in which the support substrate 100 is located according to the magnetic field generated by the corresponding spiral coil 30. Therefore, since the spiral coil 30 is located on the side of the support substrate 100 facing away from the electromagnetic support cavity array 200, the flatness of the electromagnetic support cavity array 200 located on the support substrate 100 can be ensured.

Figure 13:
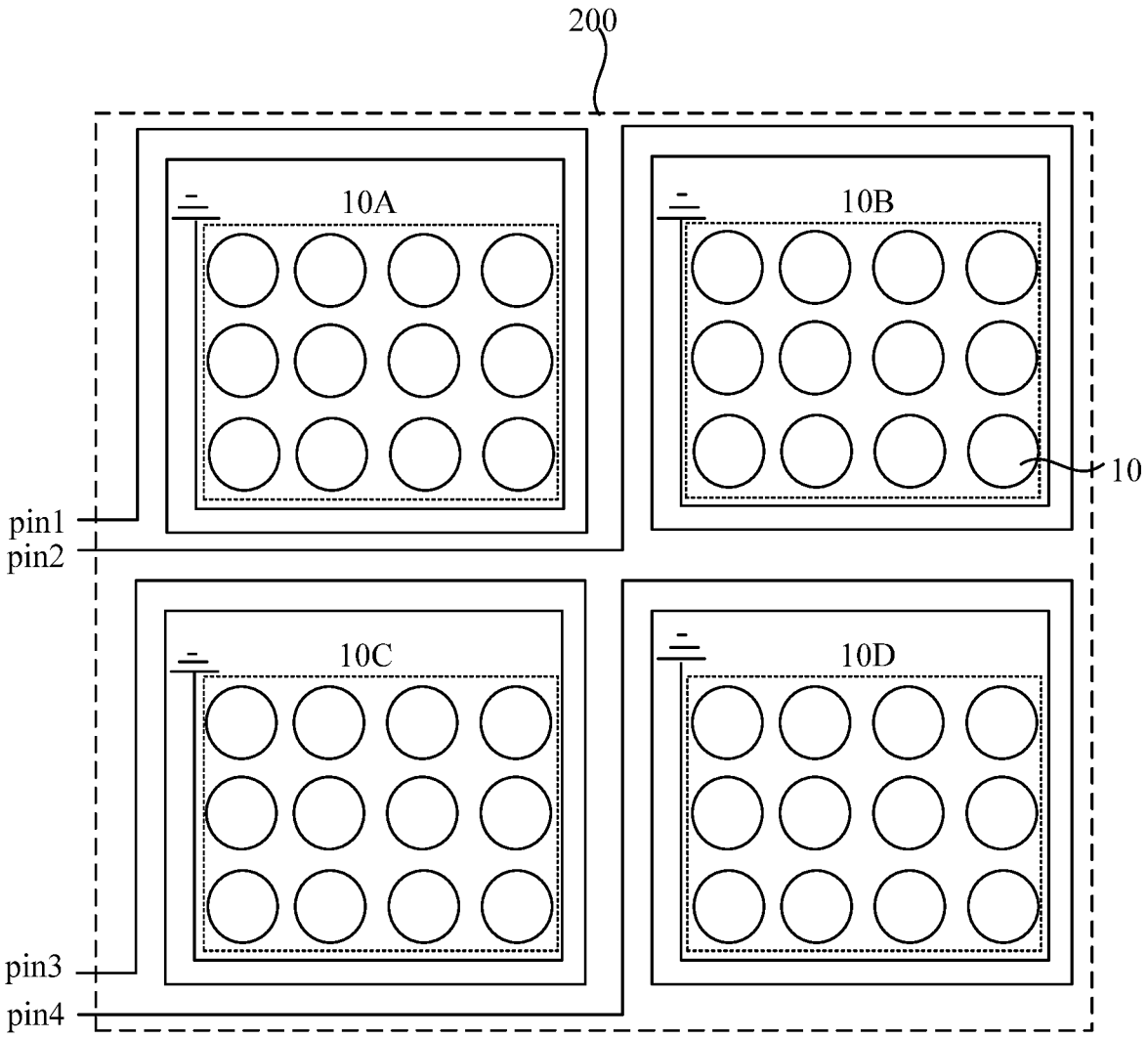
FIG. 13 is another top view of electromagnetic support cavities according to an embodiment of the present disclosure.

On the basis of the above embodiments, FIG. 13 is another top view of electromagnetic support cavities according to an embodiment of the present disclosure. As shown in FIG. 13, the support cavity array 200 may include multiple electromagnetic support cavity groups (FIG. 13 illustrates that the support cavity array includes electromagnetic support cavity groups 10A, 10B, 10C, and 10D), each electromagnetic support cavity group includes multiple adjacent electromagnetic support cavities 10, and each electromagnetic support cavity group corresponds to one of the magnetic field generation circuits.

Exemplarily, as shown in FIG. 13, the electromagnetic support cavity array includes electromagnetic support cavity groups 10A, 10B, 10C, and 10D. The electromagnetic support cavity array is divided into multiple electromagnetic support cavity groups, and each electromagnetic support cavity group corresponds to one magnetic field generation circuit, so that the phenomenon that the support apparatus has the complex circuit structure and a lot of output ports of the control module are occupied due to the large number of magnetic field generation circuits can be avoided when the support apparatus is applied to carry a relatively large flexible object. FIG. 13 is described by using an example of four electromagnetic support cavity groups. Each of the four electromagnetic support cavity groups corresponds to one magnetic field generation circuit. All electromagnetic support cavities 10 of the same electromagnetic support cavity group share one magnetic field generation circuit, so that the deformation of the electromagnetic support cavities 10 in the same electromagnetic support cavity group is basically the same. For example, the magnetic field generation circuit corresponding to the electromagnetic support cavity group 10A is controlled to generate a magnetic field B1, the magnetic field generation circuit corresponding to the electromagnetic support cavity group 10B is controlled to generate a magnetic field B2, the magnetic field generation circuit corresponding to the electromagnetic support cavity group 10C is controlled to generate a magnetic field B3, and the magnetic field generation circuit corresponding to the electromagnetic support cavity group 10D is controlled to generate a magnetic field B4. Magnetic fields B1, B2, B3 and B4 are at least partially different.

It is to be noted that in FIG. 13, pin1 is a signal input terminal of the magnetic field generation circuit corresponding to the electromagnetic support cavity group 10A, pin2 is a signal input terminal of the magnetic field generation circuit corresponding to the electromagnetic support cavity group 10B, pin3 is a signal input terminal of the magnetic field generation circuit corresponding to the electromagnetic support cavity group 10C, and pin4 is a signal input terminal of the magnetic field generation circuit corresponding to the electromagnetic support cavity group 10D. The control module 400 inputs a control signal such as a current signal to the magnetic field generation circuits 300 through the signal input terminals of the magnetic field generation circuits to adjust the magnitudes of the magnetic fields generated by the magnetic field generation circuits 300.

It is to be noted that FIG. 13 illustrates one division manner of electromagnetic support cavity groups while the magnetic field support cavity groups may be divided according to the deformation manner of the flexible object, and the embodiments of the present disclosure do not limit the division manner of the electromagnetic support cavity groups.

Figure 14:
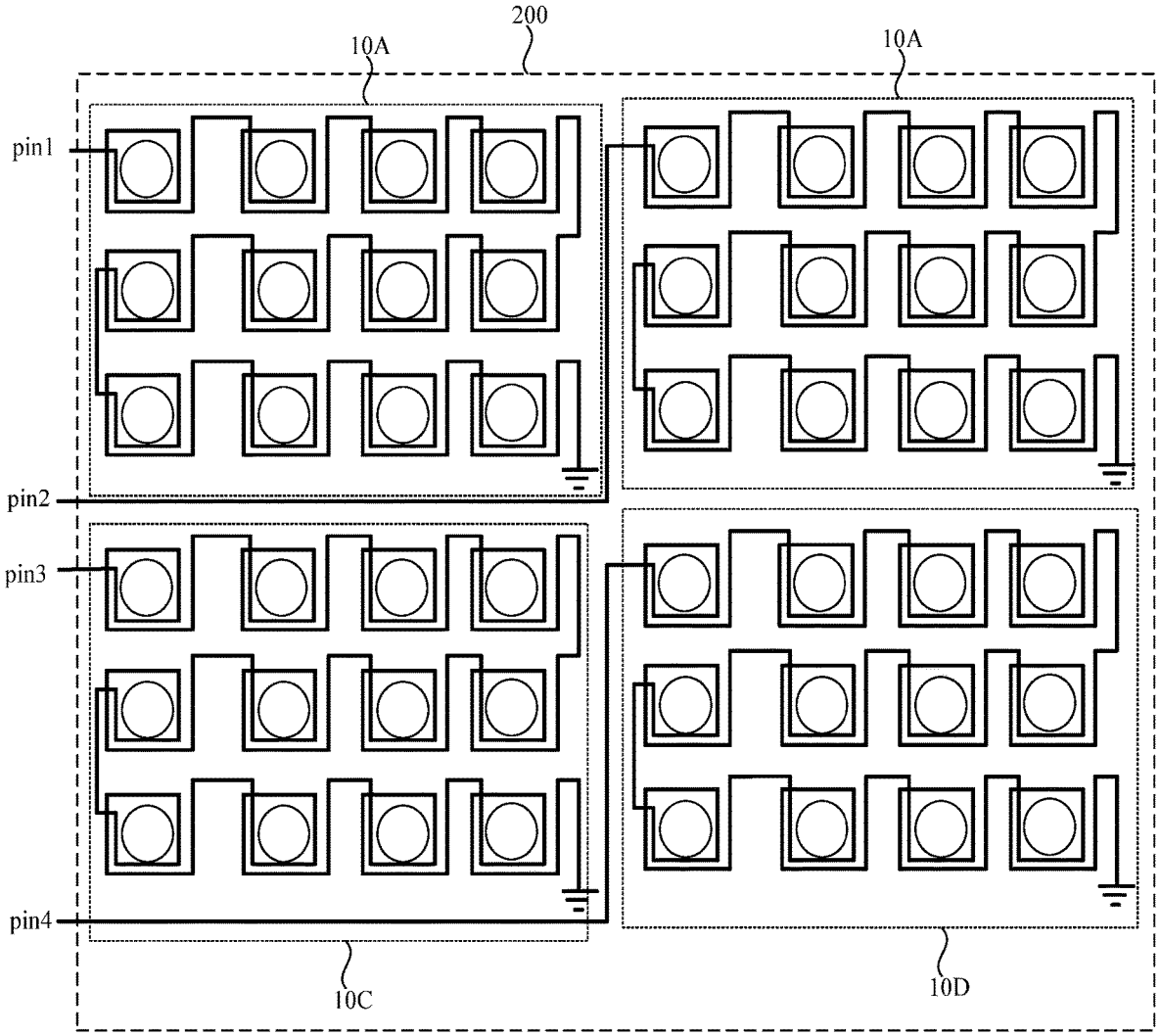
FIG. 14 is another top view of electromagnetic support cavities according to an embodiment of the present disclosure.

On the basis of the above embodiments, FIG. 14 is another top view of electromagnetic support cavities according to an embodiment of the present disclosure. As shown in FIG. 14, the electromagnetic support cavity array may include multiple electromagnetic support cavity groups, each electromagnetic support cavity group includes multiple adjacent electromagnetic support cavities, the electromagnetic support cavities have the one-to-one correspondence with the magnetic field generation circuits, and magnetic field generation circuits corresponding to electromagnetic support cavities which belong to the same electromagnetic support cavity group are connected in series.

Exemplarily, as shown in FIG. 14, the electromagnetic support cavity array includes electromagnetic support cavity groups 10A, 10B, 10C, and 10D, where magnetic field generation circuits corresponding to electromagnetic support cavities in the electromagnetic support cavity group 10A are connected in series, magnetic field generation circuits corresponding to electromagnetic support cavities in the electromagnetic support cavity group 10B are connected in series, magnetic field generation circuits corresponding to electromagnetic support cavities in the electromagnetic support cavity group 10C are connected in series, and magnetic field generation circuits corresponding to electromagnetic support cavities in the electromagnetic support cavity group 10D are connected in series. Therefore, the magnetic field generation circuits corresponding to electromagnetic support cavities in each electromagnetic support cavity group are connected in series and are finally connected to the control module 400 through one signal input terminal, so that the purpose of reducing the number of output ports of the control module 400 can also be realized.

With reference to FIG. 14, pin1 is a signal input terminal formed by a serial connection of the magnetic field generation circuits corresponding to the electromagnetic support cavities in the electromagnetic support cavity group 10A, pin2 is a signal input terminal formed by a serial connection of the magnetic field generation circuits corresponding to the electromagnetic support cavities in the electromagnetic support cavity group 10B, pin3 is a signal input terminal formed by a serial connection of the magnetic field generation circuits corresponding to the electromagnetic support cavities in the electromagnetic support cavity group 10C, and pin4 is a signal input terminal formed by a serial connection of the magnetic field generation circuits corresponding to the electromagnetic support cavities in the electromagnetic support cavity group 10D.

It is to be noted that the negative electrode of each magnetic field generation circuit 300 is set to be grounded as exemplified in FIG. 13 and FIG. 14. In other implementations, a common low potential may be provided for the negative electrode of each magnetic field generation circuit 300 to form a loop.

In addition, in the above embodiments, if the magnetic field generation circuit 300 includes the spiral coil 30, the number of turns of the spiral coil of each magnetic field generation circuit 300 may be the same or different. In FIG. 14, magnetic field generation circuits corresponding to electromagnetic support cavities of the same electromagnetic support cavity group may have a same number of coil turns or different numbers of coil turns. According to the magnetic field strength formula, it can be obtained that the strength of the magnetic field is proportional to both the number of coil turns and the current. Therefore, the magnitude of the magnetic field generated by the magnetic field generation circuit can be controlled by adjusting at least one of the number of coil turns, the value of the current, and the area of the magnetic field absorption layer.

On the basis of the above embodiments, the embodiments of the present disclosure may further provide a flexible device. The flexible device includes a flexible object and the support apparatus described in any one of the above embodiments, and the flexible object is located on a side of the electromagnetic support cavity array facing away from the support substrate.

Figure 15:
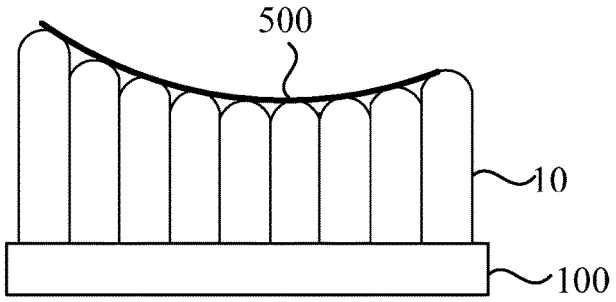
FIG. 15 is a sectional diagram of a flexible device according to an embodiment of the present disclosure.

Exemplarily, as shown in FIG. 15, a flexible object 500 is carried on the side of the electromagnetic support cavity array 200 facing away from the support substrate 100. When the control module controls the magnetic fields generated by the magnetic field generation circuits to make the electromagnetic support cavities 10 deform in the direction perpendicular to the plane in which the support substrate 100 is located, the flexible object 500 located on the electromagnetic support cavities 10 may be formed into a flexible curved surface having different forms according to the deformation manner of the electromagnetic support cavities 10.

Figure 16:
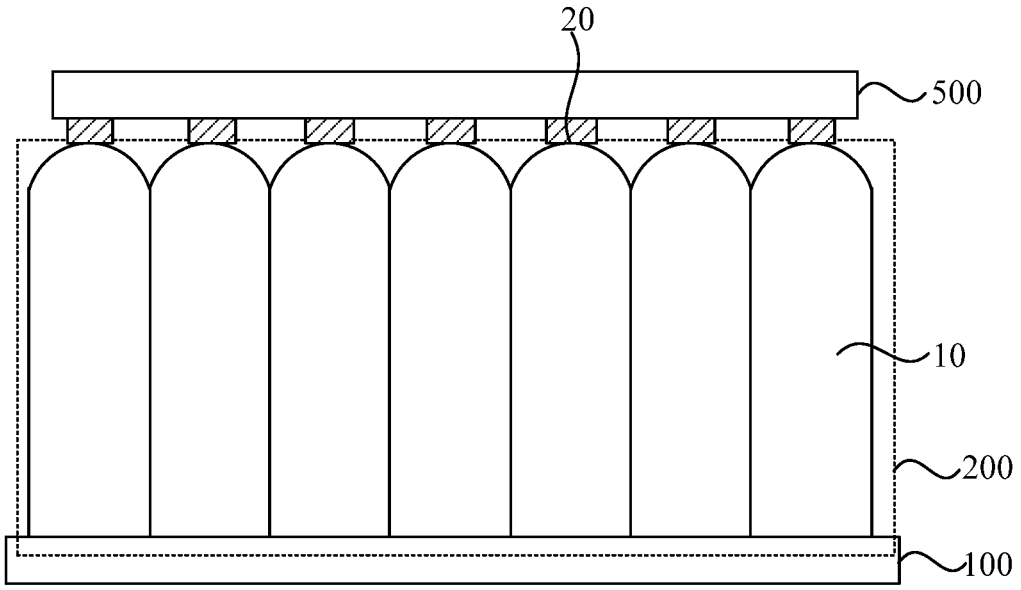
FIG. 16 is another sectional diagram of a flexible device according to an embodiment of the present disclosure.
Figure 17:
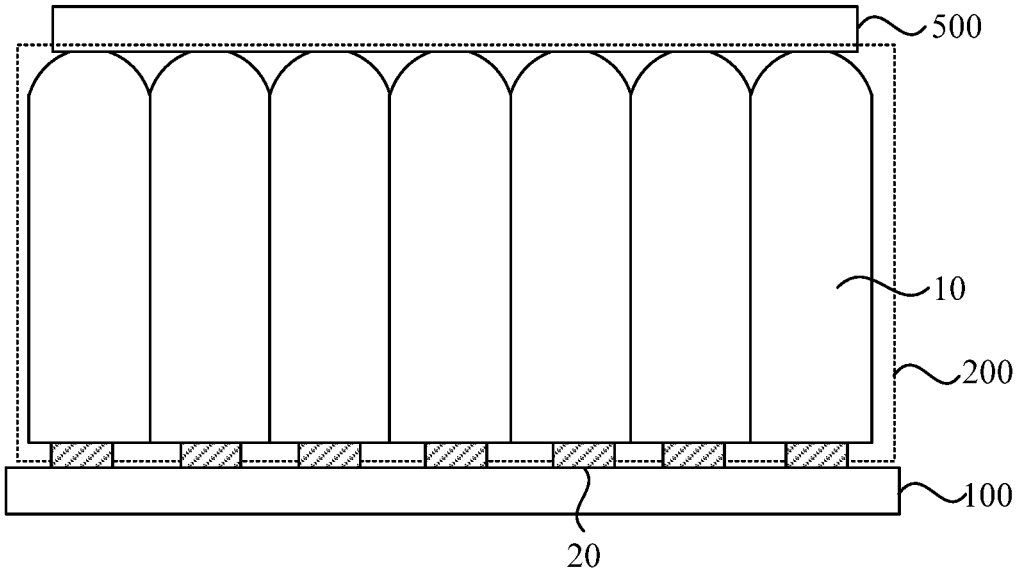
FIG. 17 is another sectional diagram of a flexible device according to an embodiment of the present disclosure.

Pressure sensors 20 may be provided between the electromagnetic support cavities 10 and the flexible object 500, as shown in FIG. 16; alternatively, the pressure sensors 20 may be provided between the electromagnetic support cavities 10 and the support substrate 100, as shown in FIG. 17. The control module may adjust the magnitude of each magnetic field generated by the corresponding magnetic field generation circuit according to a sensed pressure of a respective one of the pressure sensors 20, and/or, the control module determines whether the support apparatus is adjusted into a target support shape according to sensed pressures of the pressure sensors 20 and preset pressures.

It is noted that one pressure sensor 20 may be provided between the electromagnetic support cavities 10 and the flexible object 500, or, between the electromagnetic support cavities 10 and the support substrate 100; alternatively, multiple pressure sensors 20 may be provided between the electromagnetic support cavities 10 and the flexible object 500, or, between the electromagnetic support cavities 10 and the support substrate 100. The number of pressure sensors 20 is not limited by the embodiments of the present disclosure.

It is also understood that in a case where only one pressure sensor 20 is provided, one corresponding preset pressure is set; and in a case where multiple pressure sensors 20 are provided, preset pressures are set correspondingly. The number of preset pressures is not limited by the embodiments of the present disclosure.

That is, there are multiple methods for the control module controlling the magnitude of magnetic fields generated by the multiple magnetic field generation circuits. For example, a user presses the flexible object 500, the pressure sensors 20 at different positions sense corresponding pressures, and the control module 400 controls the magnitude of the magnetic field generated by each magnetic field generation circuit 300 according to a respective pressure value. For example, the control module 400 controls the value of the current transmitted to a magnetic field generation circuit 300 according to the respective pressure value to adjust the magnitude of the magnetic field generated by the respective one of the multiple magnetic field generation circuits 300.

Alternatively, the control module 400 may also automatically adjust the magnitudes of the magnetic fields generated by the magnetic field generation circuits 300 according to a control instruction. For example, the control module 400 controls the value of the current transmitted to each magnetic field generation circuit 300 according to the control instruction to adjust the magnitude of the magnetic field generated by each magnetic field generation circuit 300. Each electromagnetic support cavity in the electromagnetic support cavity array deforms in the direction perpendicular to the plane in which the support substrate is located and bends into the target support shape according to the magnitude of the magnetic field generated by the respective one of the multiple magnetic field generation circuits.

In order to realize the closed-loop feedback, on the basis of the above embodiments, whether the support apparatus is adjusted to the target support shape may also be determined based on the sensed pressures of the pressure sensors and the preset pressures. Since the electromagnetic support cavities deform differently in the direction perpendicular to the plane in which the support substrate is located, the sensed pressures of the pressure sensors are different. That is, when the support apparatus is in the target support shape, the sensed pressure of each pressure sensor should be a preset pressure corresponding to the target support shape. If the sensed pressure of each pressure sensor is different from the preset pressure corresponding to the target support shape, it indicates that the support apparatus has not been adjusted in the target support shape. At this point, the control module may continue to adjust the magnetic fields generated by the multiple magnetic field generation circuits until each electromagnetic support cavity is adjusted to the target support shape.

The flexible object may include one of a flexible display panel, a flexible electronic chip, or a flexible solar cell.

Exemplarily, the embodiments of the present disclosure will be described in detail by using an example that the flexible object is a flexible display panel. In other application scenarios, the flexible object may be a flexible electronic product in a flexible wearable device, such as a flexible electronic chip or a flexible solar cell. The embodiments of the present disclosure do not limit the flexible object.

It is to be noted that the flexible display panel provided in the embodiments of the present disclosure may be a display panel in a mobile phone, a tablet computer, a smart wearable device (such as a smartwatch), and other display devices having the fingerprint recognition function as known to those skilled in the art, and the embodiments of the present disclosure do not limit it thereto.

Figure 18:
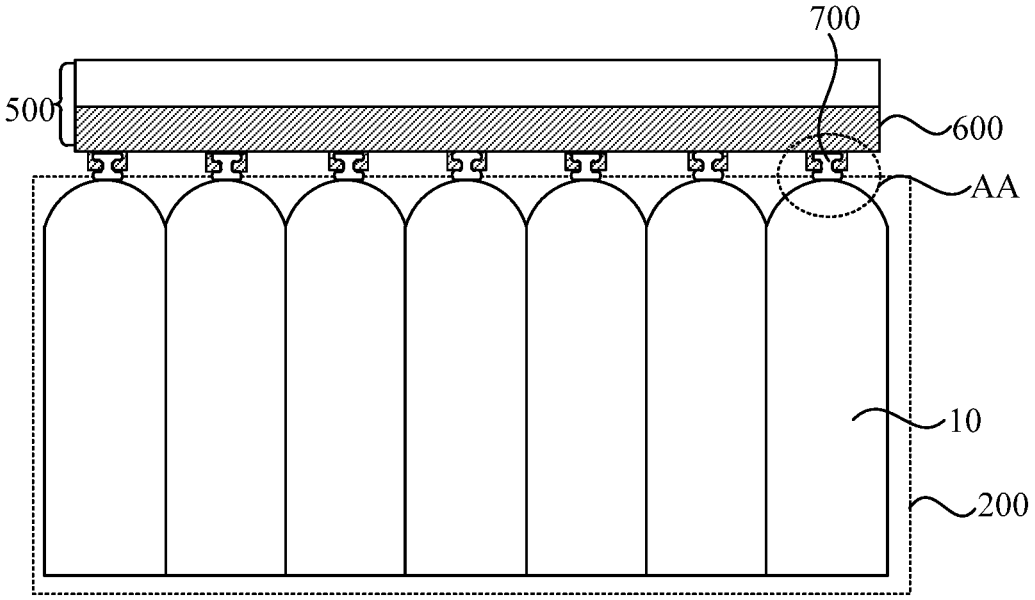
FIG. 18 is another sectional diagram of a flexible device according to an embodiment of the present disclosure.
Figure 19:
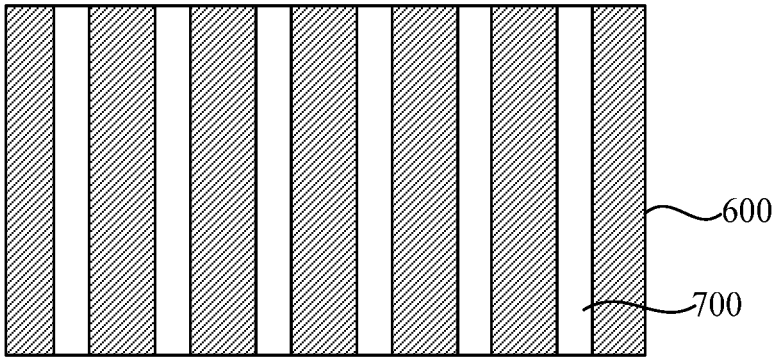
FIG. 19 is a top view of the flexible device illustrated in FIG. 18.
Figure 20:
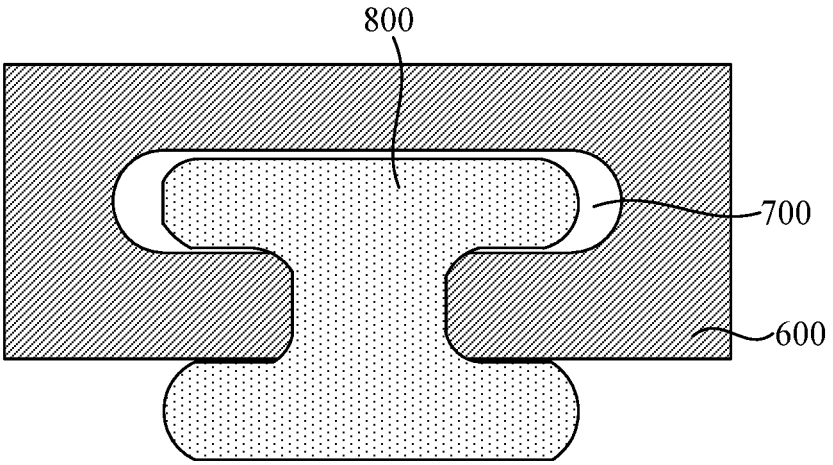
FIG. 20 is an enlarged structural diagram of area AA of the flexible device illustrated in FIG. 18.

On the basis of the above embodiments, FIG. 18 is a sectional diagram of another flexible device according to an embodiment of the present disclosure, FIG. 19 is a top view of the flexible device illustrated in FIG. 18, and FIG. 20 is an enlarged structural diagram of area AA of the flexible device illustrated in FIG. 18. The flexible object 500 includes an isolation film 600 which is located on the side of the flexible object 500 facing towards the electromagnetic support cavity array 200. At least one guide slot 700 is provided on a side of the isolation film 600 facing towards the electromagnetic support cavity array 200, each guide slot 700 is provided with a guide member 800 capable of sliding along the respective guide slot 700, and a respective one of the multiple electromagnetic support cavities 10 is connected to the guide member 800.

It is noted that the number of guide members 800 is not limited by the embodiments of the present disclosure, and the number of electromagnetic support cavities 10 corresponding to the guide member(s) 800 may also be not limited by the embodiments of the present disclosure. For example, only part of the multiple electromagnetic support cavities 10 are connected to the guide member(s) 800; for another example, all of the multiple electromagnetic support cavities 10 are connected to the guide members 800 in one-to-one correspondence.

In conjunction with FIGS. 18, 19, and 20, the flexible object 500 is provided with an isolation film 600 on the side of the flexible object 500 facing towards the electromagnetic support cavity array 200, the isolation film 600 is provided with at least one guide slot 700 on the side of the isolation film 600 facing towards the electromagnetic support cavity array 200, and a guide member 800 is provided within each guide slot 700. When the flexible object 500 deforms, the guide member 800 slides within the guide slot 700 to achieve conforming between the flexible object 500 and the electromagnetic support cavities 10; besides, since the guide member 800 is capable of sliding along the corresponding guide slot 700, the guide member 800 is prevented from disengaging from the guide slot 700 when sliding along the guide slot 700.

Figure 21:
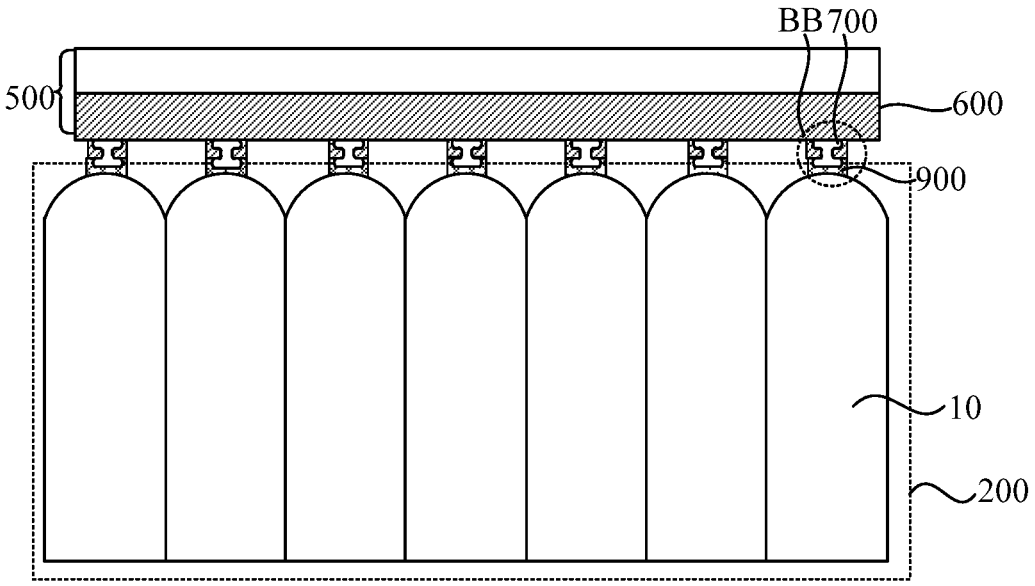
FIG. 21 is another sectional diagram of a flexible device according to an embodiment of the present disclosure.
Figure 22:
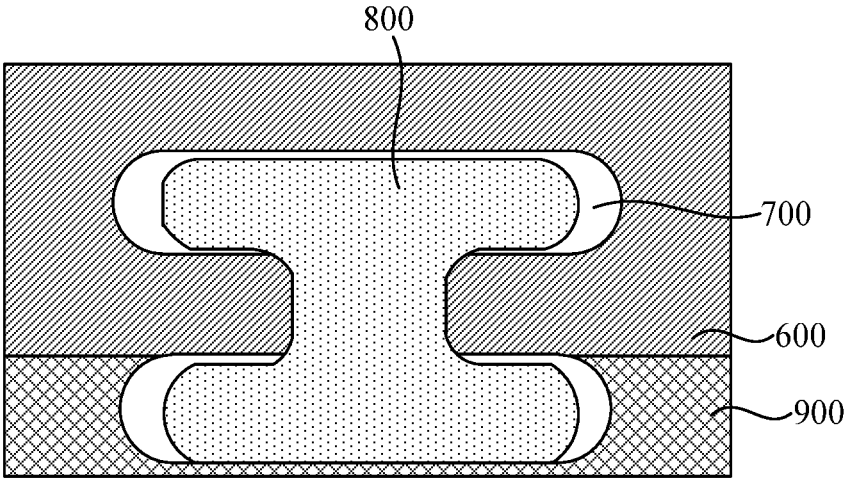
FIG. 22 is an enlarged view of area BB of the flexible device illustrated in FIG. 21.

On the basis of the above embodiments, FIG. 21 is another sectional diagram of a flexible device according to an embodiment of the present disclosure, and FIG. 22 is an enlarged view of area BB of the flexible device illustrated in FIG. 21. As shown in FIG. 21 and FIG. 22, a snap structure 900 is provided on a side of the electromagnetic support cavity array 200 facing away from the support substrate, and the guide member 800 is engaged with the snap structure 900.

With reference to FIG. 21 and FIG. 22, the snap structure 900 is provided on the side of the electromagnetic support cavity array 200 facing away from the support substrate, so that the conforming between the electromagnetic support cavities 10 and the flexible object 500 is achieved by means of the engagement of the guide member 800 and the snap structure 900.

The flexible device may further include a crimping/drawing receiving chamber. When the flexible object deforms, the flexible object may be crimped into the crimping/drawing receiving chamber or drawn from the crimping/drawing receiving chamber, and the flexible object is received by the crimping/drawing receiving chamber.

It is to be noted that the preceding are only alternative embodiments of the present disclosure and the technical principles used therein. It is to be understood by those skilled in the art that the present disclosure is not limited to the embodiments described herein. Those skilled in the art can make various apparent modifications, adaptations, combinations and substitutions without departing from the scope of the present disclosure. Therefore, while the present disclosure has been described in detail via the preceding embodiments, the present disclosure is not limited to the preceding embodiments and may include equivalent embodiments without departing from the concept of the present disclosure. The scope of the present disclosure is determined by the scope of the appended claims.

What is claimed is:

1. A support apparatus, comprising:

a support substrate;

an electromagnetic support cavity array, which is located on the support substrate and comprises a plurality of electromagnetic support cavities; and a plurality of magnetic field generation circuits and a control module;

wherein the plurality of magnetic field generation circuits are electrically connected to the control module, and the control module is configured to control the plurality of magnetic field generation circuits to generate magnetic fields to make the plurality of electromagnetic support cavities deform along a direction perpendicular to a plane in which the support substrate is located; and wherein each of the plurality of electromagnetic support cavities comprises an electromagnetic material layer and a magnetic field absorption layer, and the magnetic field absorption layer has a hollow pattern and is located on an inner side wall of the electromagnetic material layer.

2. The support apparatus of claim 1, wherein a side of the electromagnetic support cavity array facing away from the support substrate is an arc surface.

3. The support apparatus of claim 1, wherein a side of the plurality of electromagnetic support cavities facing away from the support substrate is configured to carry a flexible object.

4. The support apparatus of claim 1, wherein each of the plurality of electromagnetic support cavities comprises an electromagnetic material layer and a protection layer, and the protection layer is located on an outer side wall of the electromagnetic material layer.

5. The support apparatus of claim 1, wherein magnetic field absorption layers of at least a partial number of the plurality of electromagnetic support cavities have different areas.

6. The support apparatus of claim 5, wherein the plurality of magnetic field generation circuits are connected in series.

7. The support apparatus of claim 1, wherein each of the plurality of electromagnetic support cavities has a same area of the magnetic field absorption layer, and the control module is configured to adjust magnetic fields generated by at least a partial number of the magnetic field generation circuits to be different, so that the at least a partial number of the electromagnetic support cavities deform differently along the direction perpendicular to the plane in which the support substrate is located.

8. The support apparatus of claim 1, wherein the magnetic field absorption layer comprises a carbon-based conductive polymer.

9. The support apparatus of claim 1, wherein each of the plurality of magnetic field generation circuits comprises a spiral coil, and the spiral coil is located on an inner side wall or an outer side wall of a respective one of the plurality of electromagnetic support cavities.

10. The support apparatus of claim 1, wherein each of the plurality of magnetic field generation circuits comprises a spiral coil, and the spiral coil is located on the support substrate.

11. The support apparatus of claim 1, wherein the electromagnetic support cavity array comprises a plurality of electromagnetic support cavity groups, each of the plurality of electromagnetic support cavity groups comprises a plurality of adjacent electromagnetic support cavities, and the plurality of adjacent electromagnetic support cavities in a same electromagnetic support cavity group correspond to one of the plurality of magnetic field generation circuits.

12. The support apparatus of claim 1, wherein the electromagnetic support cavity array comprises a plurality of electromagnetic support cavity groups, each of the plurality of electromagnetic support cavity groups comprises a plurality of adjacent electromagnetic support cavities, and the plurality of electromagnetic support cavities have a one-to-one correspondence with the plurality of magnetic field generation circuits; and magnetic field generation circuits which correspond to electromagnetic support cavities which belong to a same electromagnetic support cavity group are connected in series.

13. A flexible device, comprising a flexible object and a support apparatus;

wherein the support apparatus comprises:

a support substrate;

an electromagnetic support cavity array, which is located on the support substrate and comprises a plurality of electromagnetic support cavities; and a plurality of magnetic field generation circuits and a control module;

wherein the plurality of magnetic field generation circuits are electrically connected to the control module, and the control module is configured to control the plurality of magnetic field generation circuits to generate magnetic fields to make the plurality of electromagnetic support cavities deform along a direction perpendicular to a plane in which the support substrate is located; wherein the flexible object is located on a side of the electromagnetic support cavity array facing away from the support substrate; and wherein each of the plurality of electromagnetic support cavities comprises an electromagnetic material layer and a magnetic field absorption layer, and the magnetic field absorption layer has a hollow pattern and is located on an inner side wall of the electromagnetic material layer.

14. The flexible device of claim 13, wherein a pressure sensor is provided between the plurality of electromagnetic support cavities and the flexible object, or a pressure sensor is provided between the plurality of electromagnetic support cavities and the support substrate; and the control module is configured to perform at least one of: adjusting the magnetic fields generated by the plurality of magnetic field generation circuits according to a sensed pressure of the pressure sensor; or, determining whether the support apparatus is adjusted into a target support shape according to a sensed pressure of the pressure sensor and a preset pressure.

15. The flexible device of claim 13, wherein the flexible object comprises an isolation film which is located on a side of the flexible object facing towards the electromagnetic support cavity array;

wherein at least one guide slot is provided on a side of the isolation film facing towards the electromagnetic support cavity array, each of the at least one guide slot is provided with a guide member capable of sliding along the respective one of the at least one guide slot, and at least one of the plurality of electromagnetic support cavities is connected to the guide member.

16. The flexible device of claim 15, wherein a snap structure is provided on a side of the electromagnetic support cavity array facing away from the support substrate, and the guide member is engaged with the snap structure.

17. The flexible device of claim 13, wherein each of the plurality of magnetic field generation circuits comprises a spiral coil, and the spiral coil is located on an inner side wall or an outer side wall of a respective one of the plurality of electromagnetic support cavities.

18. The flexible device of claim 13, wherein the electromagnetic support cavity array comprises a plurality of electromagnetic support cavity groups, each of the plurality of electromagnetic support cavity groups comprises a plurality of adjacent electromagnetic support cavities, and the plurality of adjacent electromagnetic support cavities in a same electromagnetic support cavity group correspond to one of the plurality of magnetic field generation circuits.

* * * * *